United States Patent [19]

Tadokoro et al.

[11] 4,331,113

[45] May 25, 1982

[54] DEVICE FOR SELECTIVE COMBUSTION IN A MULTI-CYLINDER ENGINE

[75] Inventors: Tomoo Tadokoro; Masami Nakao; Toshimichi Akagi, all of Hiroshima, Japan

[73] Assignee: Toyo Kogyo Co., Ltd., Hiroshima, Japan

[21] Appl. No.: 122,810

[22] Filed: Feb. 19, 1980

[30] Foreign Application Priority Data

Feb. 17, 1979 [JP] Japan ..... 54-19184[U]

[51] Int. Cl.[3] ..... F02D 17/00

[52] U.S. Cl. ..... 123/198 F; 123/DIG. 7; 261/23 A

[58] Field of Search ..... 123/198 F, 198 DB, DIG. 7; 261/23 A

[56] References Cited

U.S. PATENT DOCUMENTS

| | | | |
|---|---|---|---|
| 2,085,818 | 7/1937 | Messinger | 123/198 F |
| 2,114,655 | 4/1938 | Leibing | 123/198 F |
| 2,123,515 | 7/1938 | Messinger | 123/198 F |
| 3,578,116 | 5/1971 | Nakajima et al. | 123/198 F |
| 4,019,479 | 4/1977 | Garabedian | 123/198 F |
| 4,076,003 | 2/1978 | Garabedian | 123/198 F |
| 4,106,471 | 8/1978 | Nakajima et al. | 123/198 F |
| 4,109,634 | 8/1978 | Garabedian | 123/198 F |
| 4,130,102 | 12/1978 | Churchill | 123/198 F |

*Primary Examiner*—Ira S. Lazarus

*Attorney, Agent, or Firm*—Wenderoth, Lind & Ponack

[57] ABSTRACT

A device for effecting selective combustion in a multi-cylinder automobile engine including at least first and second engine cylinders comprises a shutter valve for interrupting the supply of a combustible air-fuel mixture to the first engine cylinder during a particular engine operating condition, for example, idling and deceleration. A single control valve assembly in the form of a diaphragm valve assembly is utilized to control the operation of the shutter valve and the supply of a fresh air into the first engine cylinder during the closure of the shutter valve.

13 Claims, 2 Drawing Figures

DEVICE FOR SELECTIVE COMBUSTION IN A MULTI-CYLINDER ENGINE

BACKGROUND OF THE INVENTION

The present invention generally relates to an automobile internal combustion engine and, more particularly, to a device for interrupting the supply of air-fuel mixture to some of the engine cylinders during a particular engine operating condition.

The U.S. Pat. No. 3,578,116, patented on May 11, 1971, discloses a conventional device for interrupting the supply of air-fuel mixture to some of the engine cylinders or combustion chambers during idling or deceleration to improve the combustion conditions so that any possible waste of fuel and any possible emission of a relatively large amount of noxious unburned components of the exhaust gases to the atmosphere can be minimized or substantially eliminated. This conventional device is applicable to a multi-cylinder internal combustion engine of a type having at least two engine cylinders or combustion chambers communicated with a source of air-fuel mixture, that is, a carburetor, through an intake manifold of a type including a common duct, having one end communicated with the air-fuel mixture source, and first and second branch ducts ramified from the other end of the common duct and leading to the respective engine cylinders.

The conventional device for selective combustion in the multi-cylinder engine such as disclosed in the above mentioned U.S. patent comprises a shutter or butterfly valve operatively positioned in the first branch duct for selectively closing and opening the first branch duct and normally biased to close the first branch duct by a biasing spring element, said shutter valve being pivoted in a direction against the biasing spring element to open the first branch duct in response to increase of the negative pressure which would take place inside a portion of the first branch duct upstream of the shutter valve with respect to the direction of flow of the air-fuel mixture towards the corresponding engine cylinder during idling or deceleration of the automobile engine. During the closure of the first branch duct, not only is the air-fuel mixture, which would have been introduced into the engine cylinder communicated with the first branch duct, caused to flow into the second branch duct and then towards the other engine cylinder, but also fresh air is introduced into the first branch duct at a position downstream of the shutter valve in the closed position.

In order for the shutter valve to operate in the manner described above, the conventional device further comprises an actuator, comprised of a cylindrical casing and a piston member axially slidably housed within the cylindrical casing and operatively coupled through an operating rod to the shutter valve, a switching valve assembly which is either a cylinder-and-piston arrangement or an electromagnetically operated valve device and which is operable to selectively establish and interrupt the communication between that portion of the first branch duct upstream of the shutter valve and a working chamber within the cylindrical casing, and a normally closed shut-off valve assembly including a valve member so designed as to be engageable with an engagement fast with the operating rod during the movement of the operating rod in such a direction as to bring the shutter valve into the closed position so that the fresh air can be introduced into the first branch duct at a position downstream of the shutter valve.

In this construction, the switching valve assembly is held in one position to establish the communication between that portion of the first branch duct upstream of the shutter valve and the working chamber inside the cylindrical casing when a piston element is displaced against a biasing element by the effect of a negative pressure drawn thereto from that portion of the first branch duct, and the switching valve assembly is movable to another position to interrupt the above described communication when the negative pressure so drawn thereto from that portion of the first branch duct is of a value lower than the biasing force of the biasing element. While the working chamber inside the cylindrical casing of the actuator is communicated with the atmosphere through the switching valve assembly during the incommunication between that portion of the first branch duct and the working chamber, the negative pressure introduced into the working chamber during the communication therebetween draws the piston member of the actuator and, hence, the operating rod in such a direction so as to bring the shutter valve into the closed position.

The conventional device of the above described construction is complicated in structure, since the combination of the actuator with the switching valve assembly and the shut-off valve assembly are utilized separately. Moreover, the conventional device employs a relatively large number of separate movable parts, such as the piston member in the actuator, the piston element in the switching valve assembly and the valve member in the shut-off valve assembly. Accordingly, the conventional device appears to be less reliable in operation in addition to the requirement of the increased manufacturing cost.

SUMMARY OF THE INVENTION

Accordingly, the present invention has been developed with the objective of substantially eliminating the disadvantages and inconveniences inherent in the conventional device and is intended to provide an improved device which is simple in construction thereby not involving an increased number of manufacturing steps, reliable in operation with a minimal number of separate movable parts and can readily be installed relative to the automobile engine.

According to the present invention, the above described and other objects of the present invention can readily be accomplished by providing a single control valve assembly capable of undertaking substantially all the functions which, according to the conventional device referred to above, have heretofore been performed separately, but in sequence, by the actuator, switching valve assembly and shut-off valve assembly, respectively. More specifically, the control valve assembly employed in the device of the present invention comprises a diaphragm valve assembly specifically and specially designed for the purpose of the present invention.

The present invention is applicable to a multi-cylinder internal combustion engine of a type requiring a source of combustible air-fuel mixture, and including at least one pair of intake passages connected at one end to the source of combustible mixture and at the other end to respective engine cylinders and a connecting passage communicating the intake passages with each other at a position downstream of the source of combustible mixture with respect to the direction of flow of the combustible mixture towards the engine cylinders. The source of combustible mixture generally includes a carburetor of any known construction having at least one intake duct, where fuel supplied from a source of fuel is mixed with air supplied from a source of air, and a throttle valve for controlling the rate of delivery of the combustible mixture to the engine cylinders.

Where a generally Y-shaped intake manifold having a main duct, communicated with the combustible mixture source, and branch ducts ramified therefrom and constituting the intake passages referred to above is employed, the connecting passage referred to above may comprise the passage defined by the junction of the main duct to both of the branch ducts.

The number and position of intake passages, where the supply of combustible mixture to the associated engine cylinders is selectively interrupted during a particular engine operating condition, that is, deceleration and idling, may be determined in consideration of the firing sequence of the engine cylinders and in such a manner as described in the aforesaid U.S. patent.

The control valve assembly used in the device of the present invention includes a shutter valve positioned inside one of the at least two intake passages for movement between closed and opened positions and located in the proximity of and downstream of the connecting passage, and a central valve comprising a valve casing having a diaphragm member dividing the interior of the valve casing into a negative pressure chamber, which communicates with a first portion of said one of the intake passages downstream of the shutter valve through a three-way electromagnetic valve assembly, and an atmospheric chamber, which communicates with a source of fresh air, for example with an air cleaner, and also communicates with a second portion of said one of the intake passages downstream of both of the shutter valve and the first portion of said one of the intake passages. The diaphragm member is operatively coupled to the shutter valve through an operating rod having one end secured thereto and the other end operatively coupled to the shutter valve.

The atmospheric chamber within the valve casing of the control valve assembly is so designed that, when the diaphragm member is normally biased in one direction with the shutter valve held consequently in the closed position, the communication between the source of fresh air and the second portion of the one of the intake passages by way of the atmospheric chamber is interrupted by the diaphragm member, and when the diaphragm member is displaced in the opposite direction with the shutter valve held consequently in the opened position, such communication is established by way of the atmospheric chamber.

The three-way electromagnetic valve assembly is operable to establish the communication between the negative pressure chamber and the first portion of the one of the intake passages only during a particular engine operating condition. However, during an engine operating condition other than idling and deceleration, the negative pressure chamber is communicated to the atmosphere through the three-way electromagnetic valve assembly which assumes a different operational position.

In general, it is well recognized that, during the idling and deceleration of the automobile engine, ignition of the combustible mixture supplied to the engine cylinders is nonexistent or is insufficient so as to fail to ignite the combustible mixture distributed to the engine cylinder unless the combustible mixture supplied to the engine cylinders during these particular engine operating conditions is enriched. However, the use of the enriched combustible mixture is undesirable in terms of fuel economy, atmospheric pollution and engine operating characteristic.

Although the conventional device disclosed in the aforesaid U.S. patent is effective to minimize or substantially eliminate the above described drawbacks, the present invention is featured in that the substantially same effects as achieved by the conventional device are achieved by the use of the simplified, inexpensive and each-to-install control valve assembly of a construction summarized above and described in detailed hereinafter.

BRIEF DESCRIPTION OF THE DRAWINGS

These and other objects and features of the present invention will become apparent from the following description taken inconjunction with a preferred embodiment thereof with reference to the accompanying drawings, in which.

DETAILED DESCRIPTION OF THE INVENTION

Figure 2:
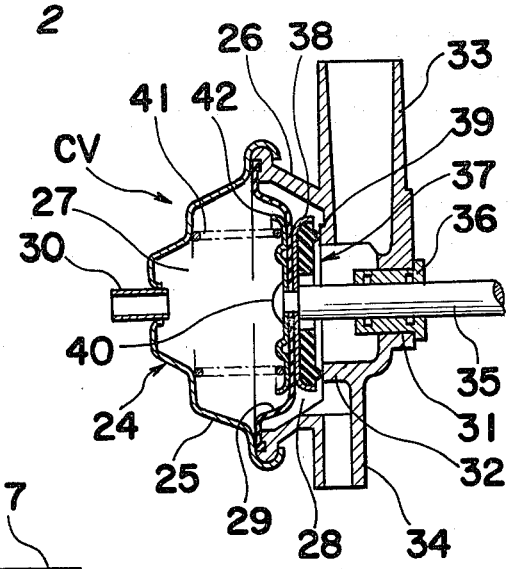
FIG. 2 is a side sectional view, on an enlarged scale, of a control valve assembly used in the device of FIG. 1.

Before the description of the present invention proceeds, it is to be noted that like parts are designated by like reference numerals throughout the accompanying drawings. It is also to be noted that, although the present invention is equally applicable with any known carburetor having the only one intake duct for all of the engine cylinders as hereinbefore described, the present invention will be described as applied to an automobile engine having a plurality of, for example two, engine cylinders and also having a carburetor of a type having separate first and second intake ducts and a correspondingly separate throttle valve within each intake duct.

Figure 1:
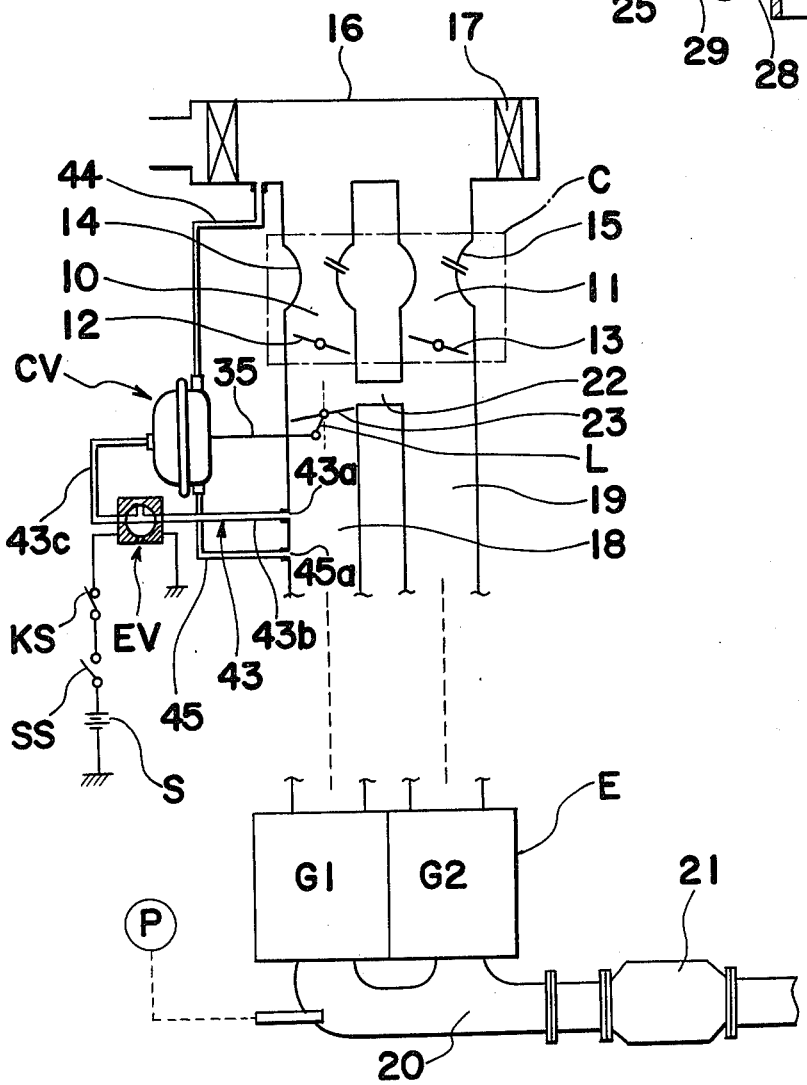
FIG. 1 is a schematic diagram showing a device for selective combustion in a multi-cylinder engine employing the present invention.

Referring now to FIG. 1, the carburetor is generally identified by C and has first and second intake ducts 10 and 11 extending therethrough, throttle valves 12 and 13 supported inside the respective intake ducts 10 and 11 for pivotal movement between full open and substantially closed positions and operable in any known manner, and venturi sections 15 and 16 positioned inside the respective intake ducts 10 and 11 upstream of the associated throttle valves 12 and 13. The first and second intake ducts 10 and 11 are communicated at one end with the atmosphere through an air cleaner 16 mounted atop the carburetor C and having a ring-shaped, replaceable filtering element 17 as is well known to those skilled in the art. These first and second intake ducts 10 and 11 are also communicated at their respective other ends to respective engine cylinders G1 and G2 of an automobile internal combustion engine E through associated first and second intake passages 18 and 19. The engine cylinders G1 and G2 are in turn communicated to the atmosphere through an exhaust manifold 20 having any known exhaust gas purifying unit 21, either a catalytic converter or an afterburner, installed thereon in a manner known to those skilled in the art.

In the proximity of the carburetor C, the first and second intake passages 18 and 19 are communicated with each other through a connecting passage 22, the function of which will become apparent from the subsequent description.

A shutter valve 23 for closing one of the first and second intake passages 18 and 19, for example, the first intake passage 18 as illustrated, during a particular engine operating condition, e.g., idling and deceleration, is installed inside the first intake passage 18 at a position in the proximity of and downwardly of the connecting passage 22 with respect to the direction of flow of combustible mixture towards the engine cylinders G1 and G2. This shutter valve 23 is supported in any known manner for pivotal movement between a closed position, shown by the solid line in FIG. 1, and an opened position shown by the broken line in FIG. 1, and it being to be understood that, when the shutter valve is in the closed position, the combustible mixture formed inside the first intake duct 10 at a position upstream of the associated throttle valve 12 by combining fuel with air is, after the rate of delivery of such combustible mixture has been regulated by the throttle valve 12, forced to flow into the second intake passage 19 through the connecting passage 22. Naturally, the combustible mixture so forced to flow into the second intake passage 19 is mixed together with the combustible mixture formed inside the second intake duct 11 in a similar manner and which flows past the associated throttle valve 13 towards the engine cylinder G2 through the second intake passage 19. It is, therefore, clear that the engine cylinder G2 receives the combustible mixture twice as much in volume as in the case of supplying the combustible mixture to all the engine cylinders G1 and G2 during the particular engine operating condition so that the combustion condition in the engine E as a whole can be improved.

The construction so far described above may be such as disclosed in the aforesaid U.S. patent.

In accordance with the present invention, in order to control the operation of the shutter valve 23 in dependence with the negative pressure developed inside an intake system downstream of the throttle valve 12, there is employed a control valve assembly CV of a construction which will now be described with particular reference to FIG. 2.

Referring to FIG. 2, the control valve assembly CV comprises a valve casing generally identified by 24 and formed by combining a pair of generally bowl-shaped casing halves 25 and 26 together to provide a compartment inside the casing 24. The compartment inside the casing 24 is divided into a negative pressure chamber 27 and an atmospheric chamber 28 by a diaphragm member 29 having its peripheral edge portion firmly clamped in position at the joint between the casing halves 25 and 26 as shown, said negative pressure chamber 27 and said atmospheric chamber 28 being situated on respective sides of the diaphragm member 29 adjacent the casing halves 25 and 26.

The casing half 25 has a coupling duct 30 having one end fast therewith and opened into the negative pressure chamber 27, the other end of said coupling duct 30 being communicated with the first intake passage 18 in a manner as will be described later. On the other hand, the casing half 26 is apertured at 31 in opposition to the diaphragm member 29 and has an annular partition wall 32 in concentric alignment with the aperture 31 and protruding into the atmospheric chamber 28 in a direction towards the diaphragm member 29. As will become clear from the subsequent description, an annular end face of the partition wall 32 remote from the aperture 31 and facing the diaphragm member 29 serves as a valve seat.

The casing half 26 also has coupling ducts 33 and 34 formed integrally therewith. The coupling duct 33 has one end protruding inwardly of the casing compartment and connected rigidly or integrally with the annular partition wall 32 so that the duct 33 is in communication with the interior space of the partition wall 32. On the other hand, the coupling duct 34 has one end connected rigidly to or is integral with the casing half 26 and the inside thereof is in communication with the atmospheric chamber 28. It will readily be seen that the coupling duct 33 is in fluid communication with the coupling duct 34 through the interior space of the partition wall 32 and through the atmospheric chamber 28. It is to be noted that the communication between the coupling ducts 33 and 34 through the interior space of the annular partition wall 32 and through the atmospheric chamber 28 can be interrupted during the engine operating condition other than idling and deceleration in the manner which will now be described.

Axially slidably extending through the aperture 31 is an operating rod 35 having one end operatively coupled to the shutter valve 23 (FIG. 1) and the other end rigidly connected to the diaphragm member 29. This operating rod 35 is axially slidably supported by the wall forming the casing half 26 by means of a dust-proof bearing sleeve 36 fitted into the aperture 31 of the casing half 26. The dust-proof bearing sleeve 36 may be of any known construction and is of a type capable of preventing dust floating outside the valve casing 24 from entering into the exterior space of the annular partition wall 32 and also from entering the atmospheric chamber 28 which would otherwise take place under the influence of a drag force developed during the flow of air from the coupling duct 33 towards the coupling duct 34 by way of the interior space of the annular partition wall 32.

As best shown in FIG. 2, the diaphragm member 29 carries a valving member 37 situated inside the atmospheric chamber 28 and comprised of an annular metal cup 38 and an annular elastic sealing element 39 of rubber material. The annular elastic sealing element 39 is of a size having its outer diameter equal to or slightly larger than the outer diameter of the annular end face of the partition wall 32 which serves as a valve seat and is non-removably connected to the annular metal cup 38 in coaxial relation therewith by the application of any suitable bonding agent or by the employment of a baking or seizing technique. The valving member 37 of the construction described above is rigidly connected to, or otherwise held flat against, the diaphragm member 29 and is mounted by a fitting bolt 40 which is axially threaded into the operating rod 35 with both the diaphragm member 29 and the annular metal cup 38 positioned between the head portion of the fitting bolt 40 and the adjacent end face of the operating rod 35.

A biasing spring 41 is interposed between the diaphragm member 29 and a portion of the casing half 25 opposed to such diaphragm member 29 and biases the diaphragm member 29 together with the valving member 37 in a first direction to cause the valving member 37 to interrupt the communication between the coupling ducts 33 and 34 by way of the interior space of the annular partition wall 32. In this condition, the sealing element 39 is tightly seated against the annular end face of the annular partition wall 32 in a manner as shown in FIG. 2. In practice, in order to avoid a direct contact of the biasing spring 41 with the diaphragm member 29 which would likely result in damage to the diaphragm member 29 and also to avoid any possible lateral displacement of the biasing spring 41 relative to the diaphragm member 29, a spring seat 42 made of metallic material is rigidly connected to, or otherwise held flat against, the diaphragm member and is positioned between the head portion of the fitting bolt 40 and the diaphragm member 29.

It is to be noted that, where the spring seat 42 is employed as shown, two possibilities can be contemplated. One is to eliminate the use of the metal cup 38, and the other is to eliminate the use of both the metal cup 38 and the sealing element 39 and, instead, to employ the diaphragm member 29 having a central area enlarged in thickness so that the thickened central area of the diaphragm member 29 can serve the function of the sealing element such as shown by 39.

It is also to be noted that, although the fitting bolt 40 has been described for connecting the spring seat 42, the diaphragm member 29 and the valving member 37 to the operating rod 35, any known rivetting technique may be employed for the same purpose.

In addition, the bearing sleeve 36 may be made of a metallic material if it serves the purpose. However, it may be made of any suitable elastic material of a kind which is generally used as a material for a gasket for sealing element.

Referring back to FIG. 1, the control valve assembly CV of the construction shown in and described with particular reference to FIG. 2 is installed in association with the fuel intake system for the engine E in such a manner that the other ends of the respective coupling ducts 30, 33 and 34 are communicated with the first intake passage 18 through a signal transmitting passage 43, with the air cleaner 16 through a first supply passage 44, and with the first intake passage 18 through a second supply passage 45. The end of the operating rod 35 remote from the diaphragm member 29 is in practice coupled to the shutter valve 23 by means of any known link mechanism L so designed that, when and so long as the diaphragm member 29 is displaced in the first direction by the action of the biasing spring 41, the shutter valve 23 can be held in the opened position to allow the supply of the combustible mixture towards the engine cylinder G1 through the first intake passage 18 and that, when the diaphragm member 29 is displaced in a second direction opposite to the first direction against the biasing spring 41 in a manner as will be described later, the shutter valve 23 can be pivoted from the opened position to the closed position to interrupt the supply of the combustible mixture towards the engine cylinder G1 through the first intake passage 18.

As best shown in FIG. 1, one end of the signal transmitting passage 43 remote from the control valve assembly CV is communicated at 43*a* with the first intake passage 18 at a position downstream of the shutter valve 23 with respect to the direction of flow of the combustible mixture towards the engine cylinder G1 whereas one end of the second supply passage 45 remote from the control valve assembly CV is communicated at 45*a* with the first intake passage 18 at a position downstream of the shutter valve 23 and the opening 43*a* of the signal transmitting passage 43.

The signal transmitting passage 45 has a substantially intermediate portion on which a three-way electromagnetic valve assembly EV is installed. This three-way electromagnetic valve assembly EV is of any known construction and operable to fluid-connect a portion 43*c* of the signal transmitting passage 43, located on one side of the valve assembly EV adjacent the control valve assembly CV, selectively with the atmosphere or with another portion 43*b* of the signal transmitting passage 43 on the other side of the valve assembly EV opposite to the passage portion 43*c*.

An electromagnetic coil (not shown) built in the valve assembly EV is electrically connected to an electric power source S, which may be a battery used in an automobile, through a key switch KS and a sensor switch SS connected in series with each other. In the present invention, it is preferred for the reason, which will be described later, that the electromagnetic valve assembly EV be held in one of two operative positions to establish communication between the passage portion 43*c* and the atmosphere when an electric current is supplied thereto and in the other of the two operative positions to establish communication between the passage portions 43*b* and 43*c*, that is, to establish the signal transmitting passage 43, when the supply of the electric current thereto is interrupted. In order for the valve assembly EV to be operable in the above described manner, the sensor switch SS is of a normally closed when energized and capable of being opened or turned off in response to increase of the negative pressure inside the first intake passage 18 and downstream of the shutter valve 23 over a predetermined value which would occur during the particular engine operating condition, that is, idling and deceleration. Where this type of sensor switch SS is employed, the employment of the key switch KS is essential to avoid an energy drain of the battery S since, without the key switch SK, the current from the battery source S would unnecessarily flow through the electromagnetic coil built in the valve assembly EV when the engine E is not in operation. In view of this, the key switch KS may be the one generally used in an automobile for controlling the entire automobile electric system and adapted to be turned on in response to the manipulation of the ignition key in readiness for the start of the engine E.

The operation of the device embodying the present invention will now be described.

Assuming that the key switch KS is closed and that the sensor switch SS is subsequently opened in response to increase over a predetermined value of the negative pressure developed inside the intake system downstream of the throttle valve 12 as a result of the engine E being operated under idling or decelerated condition, the supply of the electric power from the battery source S to the electromagnetic valve assembly EV is interrupted and, therefore, the electromagnetic valve assembly EV is brought into a first operative position to complete the signal transmitting passage 43. Upon completion of the signal transmitting passage 43 in the manner described above, the negative pressure inside the first intake passage 18 is introduced through the signal transmitting passage 43 into the negative pressure chamber 27 of the control valve assembly CV, thereby displacing the diaphragm member 29 in a direction away from the annular end face of the partition wall 32 against the biasing spring 41.

The displacement of the diaphragm member 29 in the direction against the biasing spring 41 effected in the manner described above results in the pivotal movement of the shutter valve 23 to the closed position as shown by the solid line in FIG. 1, and also establishes communication of the coupling duct 33 with the coupling duct 34 through the interior space of the annular partition wall 32 by way of the atmospheric chamber 28. Accordingly, not only is the entire amount of air-fuel mixture to be introduced into the engine cylinder G1 through the intake system including the first intake duct 10 and the first intake passage 18 forced to flow into the second intake passage 23 through the connecting passage 22 and then towards the engine cylinder G2, but fresh air which has been filtered through the filtering element 17 is also introduced into the first intake passage 18 through the first supply passage 44, then through the control valve assembly CV, and finally through the second supply passage 45.

The supply of the air-fuel mixture, which would have been introduced into the engine cylinder G1, is introduced into the engine cylinder G2 during the closure of the shutter valve 23 in the manner described above which is effective to improve the combustion condition occurring in the engine cylinder G2, since the air-fuel mixture introduced into the engine cylinder G2 is doubled in volume as compared to the case of supplying the air-fuel mixture to all of the engine cylinders.

On the other hand, the supply of the fresh air into the first intake passage 18 during the communication between the coupling ducts 33 and 34, that is, during the closure of the shutter valve 23, is effective to minimize the difference between the respective pressures one on each side of the shutter valve 23 in the closed position so that the shutter valve 23 can assuredly be held in the closed position. In addition, since the fresh air introduced into the first intake passage 18 is then exhausted from the engine cylinder G1 towards the exhaust gas purifying unit 21 without contributing to the production of an engine power output, the exhaust gas purifying unit 21 can receive a sufficient amount of air necessary to effect a substantial purification of the exhaust gases together with a secondary fresh air supplied from any suitable source of secondary air, for example, a pump P, into the exhaust manifold 20 through a supply nozzle 20*a* situated upstream of the purifying unit 21.

However, when and so long as the engine E is operated under any other operating condition than idling and deceleration, the sensor switch SS is closed, causing the electromagnetic valve assembly EV to assume the second operative position in which the passage portion 43*c* is communicated to the atmosphere, that is, the signal transmitting passage 43 is interrupted. When the valve assembly EV is in this second position, no negative pressure is introduced into the negative pressure chamber 27 of the control valve assembly CV and, therefore, the shutter valve 23 is held in the open position while the communication between the first and second supply passages 44 and 45 by way of the atmospheric chamber 28 of the control valve assembly CV is interrupted. In this condition, the air-fuel mixtures formed in the carburetor C and regulated by the corresponding throttle valves 12 and 13 in the manner described hereinbefore are supplied respectively into the engine cylinders G1 and G2.

In the foregoing description, the electromagnetic valve assembly EV has been described in assuming the first and second operative positions during the opening and closure of the sensor switch SS, respectively. This is particularly advantageous in that, in the event that the electric circuit, including the electromagnetic coil in the valve assembly EV, the power source S and the switches KS and SS, fails to operate properly by reason of breakage or the lack of sufficient electric power during the operation of the engine E, i.e., during the closure of the key switch KS, the valve assembly EV can automatically be brought into the first operative position to establish the signal transmitting passage 43. This means that, by ascertaining the lack of insufficient engine power output occurring during an engine operating condition other than idling and deceleration as a result of the closure of the shutter valve 23, the driver of the automobile can be informed of the malfunction of the electric circuit.

This electric arrangement involves an additional advantage in that the exhaust gas purifying unit 21 can be protected from any possible damage. More specifically, if as a result of the malfunction of the electric circuit, the shutter valve 23 fails to assume the closed position during the particular engine operating condition, especially during deceleration, the exhaust gases emitted from the engine E during such particular engine operating condition contain a relatively large amount of noxious unburned components, particularly hydrocarbons, which when treated in the purifying unit 23 causes an increase of the temperature of the purifying unit 21. Therefore, the automatic closure of the shutter valve 23 in the event of the malfunction of the electric circuit is effective to prevent the temperature of the purifying unit 21 from being unnecessarily increased.

However, it is possible, if desired, to design the electromagnetic valve assembly EV such as to assume the first and second operative positions during the closure and opening of the sensor switch SS, respectively. In this case, the key switch KS may not be necessary.

In the construction described above, there may be the possibility that, during the communication between the first and second supply passages 44 and 45 by way of the atmospheric chamber 28 of the control valve assembly CV with the shutter valve 23 then held in the closed position, a drag force tending to displace the diaphragm member 29 in the direction towards the annular partition wall 32 may be developed inside the atmospheric chamber 28 by the effect of a pressure difference between the pressure of the fresh air flowing through the first supply passage 44 and the negative pressure inside the first intake passage 18 downstream of the shutter valve 23. This drag force is undesirable in that it may cause a surging of the shutter valve 23 in which the latter is repeatedly vibrated about the axis of pivot thereof. This is particularly true where the effective cross sectional area of a first air supply line, including the first supply passage 44 and the coupling duct 33, is smaller than that of a second air supply line including the second supply passage 45 and the coupling duct 34.

In order to avoid the above described possibility, in the present invention, as shown in FIG. 2, the coupling duct 33 is selected so as to have a larger effective cross sectional area than that of the coupling duct 34. Alternatively, if the coupling ducts 33 and 34 or the first and second air supply lines referred to above have the same effective cross sectional areas, the same purpose can be achieved by employing an orifice in the coupling duct 34 or the second air supply line.

In addition, in view of the fact that the supply of the fresh air into the first intake passage 18 through the control valve assembly CV during the closure of the shutter valve 23 reduces, or "dilutes", the negative pressure inside the first intake passage 18 downstream of the closed shutter valve 23 to some extent, the biasing spring 41 employed in the control valve assembly CV is selected so as to exert a biasing force smaller than the negative pressure so reduced or diluted.

Although the present invention has fully been described in connection with the preferred embodiment thereof with reference to the accompanying drawings, it is to be noted that various changes and modifications are apparent to those skilled in the art. By way of example, although the coupling ducts 33 and 34 have been described as communicated with the interior space of the annular partition wall 32 and the atmospheric chamber 28, respectively, they may be communicated with the atmospheric chamber 28 and the interior space of the annular partition wall 32. In this case, care must be taken in the design of the dust-proof bearing sleeve 36 to avoid any possible intrusion of dusts from the outside of the control valve assembly CV under the influence of the negative pressure inside the interior space of the annular partition wall 32. In any event, the arrangement of the coupling ducts 33 and 34 such as shown in FIG. 2 is preferred rather than the above described alternative arrangement since the latter requires the employment of a relatively expensive and complicated dust-proof bearing sleeve.

Although the source of fresh air from which the first air supply passage 44 extends has been described as constituted by the air cleaner 16, it may be either the atmosphere or the pump P.

In addition, if a relatively large amount of fresh air is supplied into the engine cylinder G1 during the closure of the shutter valve 23, compression of the air so supplied takes place in the engine cylinder G1 along with the compression of the air-fuel mixture occurring in the engine cylinder G2 and, therefore, any possible variation of the engine torque which would occur if the piston inside the engine cylinder G1 runs idle can advantageously minimized. This can be accomplished by connecting the end of the signal transmitting passage 43, which has been described as connected to the first intake passage 18 at a position downstream of the shutter valve 23, to either the intake duct 11 downstream of the associated throttle valve 13 or to the second intake passage 19, and concurrently enlarging the effective cross sectional areas of the respective first and second air supply lines, the first air supply line including the elements 44 and 33 and the second air supply line including the elements 45 and 34. Furthermore, depending upon the type of the biasing spring 41 and in consideration of the magnitude of the negative pressure developed in the fuel intake system at a position downstream of the throttle valve, there may be employed a biasing spring for biasing the shutter valve 23 normally to the closed position.

Yet, although the particular engine operating condition during which the shutter valve 23 is held in the closed position has been described as including idling and deceleration, it may also include a light loaded operating condition of the engine.

Accordingly, such changes and modifications are to be understood as included within the true scope of the present invention unless they depart therefrom.

We claim:

1. A device for selective combustion in a multicylinder automobile engine of a type including a source of combustible air-fuel mixture and a fuel intake system extending between the combustible mixture source and at least first and second engine cylinders, said fuel intake system including a main passage communicating with the combustible mixture source and at least first and second intake passage means communicating respectively at one end with the main passage and at the other end with the respective first and second engine cylinders, said device comprising, in combination:

a shutter valve supported for movement between a closed position, in which the supply of a combustible air-fuel mixture from the combustible mixture source to the first engine cylinder is interrupted, and an opened position in which the supply of the combustible air-fuel mixture from the combustible mixture source is effected to at least the first and second engine cylinders, said shutter valve being positioned inside the first intake passage means;

a diaphragm valve assembly including a valve casing and a diaphragm member dividing the interior of the valve casing into first and second working chambers, said diaphragm member being displaceable between first and second working positions;

means for biasing the diaphragm member to the first working position;

an operating rod having one end connected to the diaphragm member and having the other end operatively coupled to the shutter valve for, when the diaphragm member is displaced from the first working position towards the second working position, moving the shutter valve from the opened position towards the closed position against the biasing means;

an air supply passage means having one end communicating with a source of fresh air and having another end communicating with the first intake passage means at a position downstream of the shutter valve, said air supply passage means having a substantially intermediate portion thereof extending through and communicating with the first working chamber in the diaphragm valve assembly, said diaphragm member, when in the first working position, interrupting the flow of fresh air from the fresh air source to the first intake passage means through the air supply passage means;

a signal transmitting passage means including first and second passage portions communicating respectively with the second working chamber in the diaphragm valve assembly and the fuel intake system for transmitting the negative pressure inside the fuel intake system to the second working chamber;

a communication means disposed between the first and second passage portions of the signal transmitting passage means for communicating the first and second passage portions with each other in response to the detection of a particular engine operating condition, whereby the diaphragm member can be displaced to the second working position with the shutter valve being consequently held in the closed position during said particular engine operating condition.

2. A device as claimed in claim 1, wherein a portion of the valve casing facing the first working chamber and in opposed relation to the diaphragm member has an annular partition wall protruding therefrom inwardly of the valve casing portion, said partition wall being spaced from the diaphragm member, the annular free end face of the partition wall providing a valve seat which the diaphragm member engages with when in the first working position, wherein a first portion of the air supply passage means extends from the fresh air source and communicates with the interior space defined by the annular partition wall and a second portion of the air supply passage means extends from the first intake passage means and communicates with the first working chamber, and said substantially intermediate portion of the air supply passage means being the interior space defined by the annular partition wall.

3. A device as claimed in claim 2, wherein the first portion of the air supply passage means has an effective cross sectional area larger than that of the second portion of the air supply passage means.

4. A device as claimed in claim 2, wherein the first mentioned end of the operating rod connected to the diaphragm member axially movably extends into the first working chamber and is in coaxial relation with the interior space defined by the annular partition wall.

5. A device as claimed in claim 1, 2, 3 or 4, wherein the biasing means comprises a biasing spring housed within the second working chamber and interposed between the valve casing and the diaphragm member.

6. A device as claimed in claim 5, wherein the diaphragm member has a valve member for closing an opening at the annular free end face of the partition wall when the diaphragm member is in the first working position.

7. A device as claimed in claim 6, wherein said valve member includes a rigid cup and an annular elastic sealing element received in the rigid cup, said valve member being mounted on the operating rod within the first working chamber and connected to the diaphragm member with the rigid cup positioned between the diaphragm member and the annular elastic sealing element.

8. A device as claimed in claim 5, further comprising a spring seat member rigidly mounted on the first mentioned end of the operating rod and positioned on a side of the diaphragm member opposite the valve member.

9. A device as claimed in claim 1, wherein the communication means comprises a three-way electromagnetic valve assembly for selectively communicating the first passage portion with the atmosphere and with the second passage portion and a sensor switch for detecting the particular engine operating condition for controlling the supply of electric power to the electromagnetic valve assembly from a source of electric power.

10. A device for selective combustion in a multicylinder automobile engine of a type including a source of combustible air-fuel mixture and a fuel intake system extending between the combustible mixture source and at least first and second engine cylinders, said fuel intake system including at least first and second intake passage means each having one end communicating with the combustible mixture source and each having another end respectively communicating with the first and second engine cylinders and a connecting passage communicating the first and second intake passage means with each other at a position downstream of the combustible mixture source, said device comprising, in combination:

a shutter valve supported for movement between a closed position, in which the supply of a combustible air-fuel mixture from the combustible mixture source to the first engine cylinder is interrupted, and an opened position in which the supply of the combustible air-fuel mixture from the combustible mixture source is effected to at least the first and second engine cylinders, said shutter valve being positioned inside the first intake passage means in the proximity of and downstream of the connecting passage when it is in the closed position;

a diaphragm valve assembly including a valve casing and a diaphragm member dividing the interior of the valve casing into first and second working chambers, said diaphragm member being displaceable between first and second working positions, a portion of the valve casing facing the first working chamber and in opposed relation to the diaphragm member having an annular partition wall inwardly protruding therefrom, said partition wall being spaced from the diaphragm member, the annular free end face of the partition wall providing a valve seat which the diaphragm member engages with when in the first working position, said diaphragm valve assembly further including a biasing spring housed within the second working chamber and interposed between the valve casing and the diaphragm member for biasing said diaphragm member to the first working position;

an operating rod having one end axially movably extending into the first working chamber and coaxially positioned with respect to the interior space defined by the annular partition wall and connected to the diaphragm member and having the other end operatively coupled to the shutter valve for, when the diaphragm member is displaced from the first working position towards the second working position against the biasing spring, moving the shutter valve from the opened position towards the closed position;

an air supply passage means comprising a first passage portion having one end communicating with a source of fresh air and having another end communicating with the interior space defined by the annular partition wall, and a second passage portion having one communicating with the first working chamber of the diaphragm valve assembly and having another end communicating with the first intake passage means at a position downstream of the shutter valve, said diaphragm member, when in the first working position, interrupting the communication between the first and second passage portions through the interior space defined by the annular partition wall and through the first working chamber, and said first passage portion having an effective cross sectional area larger than that of the second passage portion;

a signal transmitting passage means including third and fourth passage portions connected respectively to the second working chamber and the fuel intake system for transmitting the negative pressure inside the fuel intake system to the second working chamber; and a communication means disposed between the third and fourth passage portions of the signal transmitting passage means for communicating the third and fourth passage portions with each other in response to the detection of a particular engine operating condition, whereby the diaphragm member can be displaced to the second working position with the shutter valve being consequently held in the closed position during said particular engine operating condition.

11. A device as claimed in claim 10, wherein the diaphragm member has a valve member for closing an opening at the annular free end face of the partition wall when the diaphragm member is in the first working position.

12. A device as claimed in claim 11, wherein said valve member includes a rigid cup and an annular elastic sealing element received in the rigid cup, said valve member being mounted on the operating rod within the first working chamber and connected to the diaphragm member with the rigid cup positioned between the diaphragm member and the annular elastic sealing element.

13. A device as claimed in claim 10 or 11, wherein the communication means comprises an electromagnetic valve assembly and a sensor switch for detecting the particular engine operating condition for controlling the supply of electric power to the electromagnetic valve assembly from a source of electric power.

* * * * *